US006352636B1

(12) United States Patent
Wei et al.

(10) Patent No.: US 6,352,636 B1
(45) Date of Patent: Mar. 5, 2002

(54) ELECTROCHEMICAL SYSTEM AND PROCESS FOR STRIPPING METALLIC COATINGS

(75) Inventors: Bin Wei, Mechanicville; Don Mark Lipkin, Niskayuna; Leo Spitz MacDonald, Petersburgh, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/420,059

(22) Filed: Oct. 18, 1999

(51) Int. Cl.[7] ..... C25F 5/00; C25F 7/00

(52) U.S. Cl. ..... 205/717; 205/723; 204/224 M; 204/267; 204/272

(58) Field of Search ..... 205/717–721, 205/723; 204/224 M, 267, 272

(56) References Cited

U.S. PATENT DOCUMENTS

| | | | | |
|---|---|---|---|---|
| 3,779,879 A | | 12/1973 | Scott | |
| 3,788,958 A | * | 1/1974 | Dillenberg | 205/723 X |
| 4,128,463 A | * | 12/1978 | Formanik | 205/717 |
| 4,142,954 A | * | 3/1979 | Lucas | 205/717 |
| 4,246,083 A | * | 1/1981 | Notton | 205/718 |
| 4,324,626 A | * | 4/1982 | McGivern, Jr. | 205/720 |
| 4,400,248 A | * | 8/1983 | Tomaszewski | 205/723 X |
| 4,894,130 A | | 1/1990 | Sova | |
| 5,062,941 A | | 11/1991 | Sue | |

FOREIGN PATENT DOCUMENTS

| | | |
|---|---|---|
| EP | 318886 | 6/1989 |
| EP | 989210 | 3/2000 |
| WO | 41435 | 8/1999 |
| WO | 42242 | 7/2000 |

OTHER PUBLICATIONS

European Search Report No date available.

* cited by examiner

*Primary Examiner*—Donald R. Valentine
(74) *Attorney, Agent, or Firm*—Paul J. DiConza; Donald S. Ingraham

(57) ABSTRACT

An electrochemical stripping process is described that strips at least one metallic coating from a substrate. Due to the electrochemical selectivity of the disclosed process, the parent alloy is minimally affected by the electrochemical stripping process. The process comprises providing an electrolyte; disposing the coated articles and at least one electrode in the electrolyte; applying a current between the electrode and the coated articles, and removing the at least one coating from the coated articles without modifying the parent alloy. The system for the electrochemical stripping process comprises an electrolyte; a direct current source; and plurality of electrodes from which a direct current may be directed to the article being stripped. The direct current source is capable of being connected to the coated articles and the plurality of electrodes. The system permits removal of the at least one coating from the parent alloy.

33 Claims, 2 Drawing Sheets

ELECTROCHEMICAL SYSTEM AND PROCESS FOR STRIPPING METALLIC COATINGS

BACKGROUND OF THE INVENTION

The invention relates to an electrochemical stripping method. In particular, the invention relates to electrochemical stripping of metallic coatings, including aluminides, from surfaces of metallic and non-metallic components.

Stripping of metallic coatings is an important step in a number of manufacturing process, including turbine component repair. Metallic coatings are provided on articles, such as turbine components, to provide protection, for example environmental protection, to the article. Removal of a metallic coating permits at least one new coating to be applied to an article, such as a turbine component, to restore its protective properties for subsequent use. Metallic coatings are typically formed with a thickness in a range from about 5 micrometers to about 500 micrometers. The composition of diffusion or overlay metallic coatings on turbine components typically includes, but is not limited to, at least one of nickel aluminide (NiAl), platinum aluminide, MCrAlY, where M can be a combination of cobalt (Co), nickel (Ni), and iron (Fe), and modifications thereof.

A stripping process should be sufficiently selective, meaning that the stripping process removes only intended materials, while preserving an article's desired structures. For example, stripping processes should remove metallic coatings from the turbine component without consuming or otherwise modifying the underlying base alloy (also referred to as a "parent alloy"). Thus, the turbine component's structural integrity will be maintained after the stripping process. In addition, internally coated surfaces and cooling holes in a turbine component must often be preserved during a stripping process.

Chemical etching is one known method for stripping metallic coatings, such as aluminide coatings, from turbine components. In chemical etching processes, a turbine component is submerged in an aqueous chemical etchant. All exposed metallic surfaces of the turbine component are in contact with the chemical etchant. The metallic coatings on the turbine component's surfaces are corroded away by the chemical etchant by reactions known in the art. While a chemical etching process is sometimes adequate for removing metallic coatings from turbine components, some chemical stripping processes are "non-selective," meaning that the striping process does not differentiate between the coating and the underlying parent alloy. Chemical etching can thus lead to undesirable material loss, including changes in critical dimensions, such as wall thickness and cooling hole diameter, and/or structural degradation of the parent alloy, such as intergranular attack, (hereinafter, these phenomena will be referred to as "modification of the parent alloy"). Chemical etching can also lead to stripping of internal passages and cooling holes of the turbine component (often referred to as "internals"). Thus, a deficiency of conventional chemical etchants is that they can not be readily directed to appropriate locations and cannot sufficiently distinguish between the coating and parent alloy, leading to degradation of the turbine component performance and reliability. In a worst-case scenario, a turbine component may be rendered unusable and scrapped.

Known chemical stripping processes may include masking of certain turbine component structures, for example internal cooling passages or holes, to overcome the non-selective nature of the processes. Masking protects against widening of cooling holes and internal passages of an article being stripped, and also prevents removal of internal coatings, however, the masking and removal thereof are time and labor consuming, imposing unwanted cost and time to a chemical stripping process.

Further, some chemical stripping processes may also operate at elevated temperature and/or pressure, and some, if not most, use hazardous chemicals, which require expensive treatment and/or disposal. These features of chemical stripping processes add additional operating costs, equipment, and safety risks, all of which are undesirable.

Electrochemical stripping processes have been disclosed for removing coatings, however, these processes are non-selective. These processes also rely on highly acidic electrolytes and any current, which is applied, can accelerate the stripping by the acid that inherently occurs. These acidic electrolyte stripping processes can result in significant damage to the parent alloy.

Therefore, it is desirable to provide a stripping process that avoids the above-noted deficiencies of known chemical stripping processes. It is desirable to provide a stripping process for an article that is chemically selective; minimizes or completely eliminates the need for masking; does not employ hazardous chemicals; and preserves the structural and dimensional integrity of the parent alloy, internal passages, and cooling holes. Further, it is desirable to provide a stripping process that exhibits a shortened process cycle time with an associated reduction in costs.

SUMMARY OF THE INVENTION

The invention sets forth an electrochemical process that strips at least one coating from an article, in which the article is formed of a parent alloy having a composition that is distinct from the coating. The coating is stripped from the parent alloy by the electrochemical process, leaving the parent alloy essentially unaffected. The electrochemical process comprises providing an electrolyte; disposing the coated article and at least one electrode in the electrolyte; applying a current from a power source between the at least one electrode and the coated article; and removing the at least one coating from the article without modifying the parent alloy.

The invention also provides a system for an electrochemical stripping process. The system comprises an electrolyte; a direct current source; and at least one electrode in which a current flow may be established. The system provides for the removal of the at least one coating from the article by causing electrochemical reactions between the coating and electrolyte upon passage of the current. Furthermore, the removal of the at least one coating occurs with minimal modification of the parent alloy.

Another aspect of the invention sets forth an electrochemical stripping process for stripping at least one coating from a coated article, in which the article comprising a parent alloy and the at least one coating is stripped from the parent alloy by the electrochemical stripping process and the parent alloy remains essentially un-modified after the electrochemical stripping process. The electrochemical stripping process comprises providing an electrolyte that comprises a charge-carrying component and a solvent, the charge-carrying component comprises sodium chloride and the solvent comprises water; disposing the coated article and at least one electrode in the electrolyte; applying a current from a power source between the at least one electrode and the coated article; and removing the at least one coating from the coated article without modifying the parent alloy.

A further aspect of the invention sets forth an electrochemical stripping process for stripping at least one coating from a coated article, in which the article comprising a parent alloy and the at least one coating is stripped from the parent alloy by the electrochemical stripping process and the parent alloy remains essentially un-modified after the electrochemical stripping process. The electrochemical process comprises providing an electrolyte that comprises a charge-carrying component and a solvent, the charge-carrying component comprises a mixture of sodium carbonate and sodium bicarbonate and the solvent comprises water; disposing the coated article and at least one electrode in the electrolyte; applying a current from a power source between the at least one electrode and the coated article; and removing the at least one coating from the coated article without modifying the parent alloy.

A further aspect of the invention sets forth an electrochemical stripping process for stripping at least one coating from a coated article, in which the article comprising a parent alloy and the at least one coating is stripped from the parent alloy by the electrochemical stripping process and the parent alloy remains essentially un-modified after the electrochemical stripping process. The electrochemical process comprises providing an electrolyte that comprises a charge-carrying component and a solvent, the charge-carrying component comprises sodium chloride and the solvent comprises propylene glycol; disposing the coated article and at least one electrode in the electrolyte; applying a current from a power source between the at least one electrode and the coated article; and removing the at least one coating from the coated article without modifying the parent alloy.

These and other aspects, advantages and salient features of the invention will become apparent from the following detailed description, which, when taken in conjunction with the annexed drawings, where like parts are designated by like reference characters throughout the drawings, disclose embodiments of the invention.

DESCRIPTION OF THE INVENTION

Figure 1:
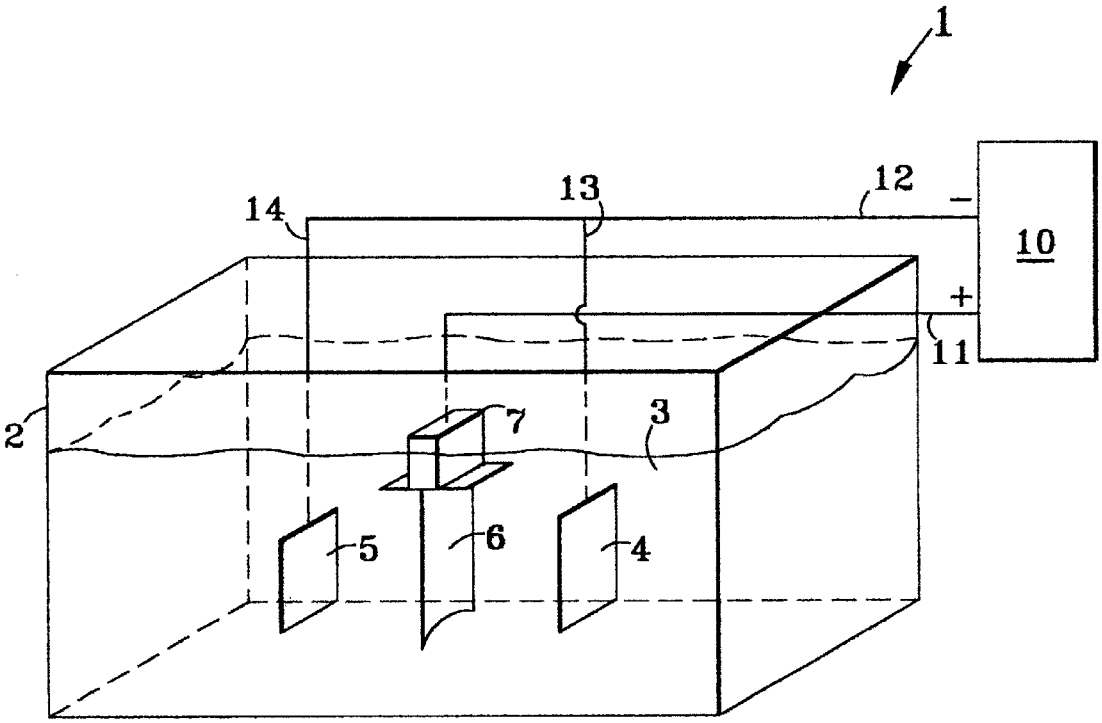
FIG. 1 is a schematic illustration of an electrochemical stripping system.

The electrochemical stripping system and its process, as embodied by the invention, strip a coated article using electrolytes. The use of the electrolytes, as embodied by the invention, provides several advantages over conventional chemical stripping processes that employ known, hazardous acids. When properly chosen, the electrochemical stripping system and process are chemically and spatially selective, preventing unwanted surface corrosion of the article, maintaining structural integrity of the article's parent alloy, and eliminating time-consuming masking steps, while protecting internal and other desired coated surfaces. The term "electrochemical selectivity" used in the context of a stripping process, as embodied by the invention, indicates differential dissolution between the parent alloy and coating material, ensuring adequate coating removal without undesirable modification and subsequent reduction in functionality of the parent alloy and its respective external and internal structures. The term "spatially selective" used in the context of a stripping process, as embodied by the invention, refers to an inherent line-of-sight character of the electrochemical stripping process, so that the stripping occurs only where a surface is directly and intentionally exposed to an electrode.

The electrolyte, as embodied by the invention, can possess a high degree of electrochemical selectivity. Thus, under certain electrochemical stripping conditions, the placement of the electrodes need not be provided with a conforming configuration to the article to be stripped. With an electrolyte having a high electrochemical selectivity, the electrodes can be disposed proximate the component and the stripping process relies upon the electrochemical selectivity of the electrolyte to remove the metallic coating without attacking the parent alloy. Therefore, the electrochemical stripping system using a chemically selective electrolyte, as embodied by the invention, can remove coatings from select areas of a turbine component and not remove or otherwise modify the parent alloy. The term "modify" used in the context of a stripping process, as embodied by the invention, refers to any undesirable material loss and/or structural degradation of the parent alloy.

The electrochemical process strips metallic coatings, including diffusion and overlay aluminide coatings and chromide coatings, from articles, such as but not limited to turbine components. In the description of the invention, the article is referred to as a turbine component and the coating is referred to as a metallic coating; however, these descriptions are not intended to be limiting of the invention. Other articles and coatings can be stripped according to the process. The term "aluminide" includes a variety of aluminum-containing coating materials that are used to impart high-temperature oxidation resistance to metal alloys. Non-limiting examples of such coatings include diffusion and overlay aluminides are chronicles, including platinum aluminide, nickel aluminide, MCrAlY (where M is at least one of Ni, Co, or Fe). For the sake of brevity, these coatings will be collectively referred to herein as "aluminide" coatings.

The electrochemical stripping process, as embodied by the invention, strips metallic coatings, such as oxidation-resistant and bond coatings, from articles. The electrochemical stripping process provides high rates of removal and can use environmentally safe chemicals. Further, the electrochemical stripping process provides for short process cycle times in addition to being chemically and spatially selective. Thus, surfaces such as cooling holes and internal cooling passages that are not directly exposed to at least one electrode will not be stripped by the electrochemical stripping process, as embodied by the invention. As a result, the electrochemical stripping process does not require the time-consuming step of masking internal cooling passages and cooling holes to protect them from at least one of inadvertent stripping and undesired material loss.

An electrochemical process, as embodied by the invention, will now be discussed with reference to the figures. FIG. 1 schematically illustrates an electrochemical stripping system 1, as embodied by the invention. In FIG. 1, the electrochemical stripping system 1 comprises an electrolyte bath receptacle 2 that contains an electrolyte 3. An exemplary electrolyte 3, as embodied by the invention, comprises a charge-carrying component, such as but not limited to a salt solution. Further, the electrolyte, as embodied by the invention, is generally non-toxic, and is not corrosive to the article being stripped. For example, this electrolyte provides the electrochemical stripping system 1 with high dissolution selectivity and minimal chemical corrosion of the parent alloy. The electrolyte's solvent may comprise at least one of an organic solvent and an inorganic solvent. The solvent may comprise water, diethylene glycol and water; glycerol and water; ethylene carbonate and water; or propylene glycol and water. The salt, which functions as the charge-carrying component, may comprise, but are not limited to, halide salts. The halide salts may be selected from at least one of sodium chloride (NaCl), sodium bromide (NaBr), and potassium chloride (KCl).

The electrolyte bath receptacle 2 (hereinafter "receptacle") comprises any appropriate non-reactive receptacle. The shape and capacity of the receptacle 2 may vary according to the application, as long as the receptacle 2 is sized sufficiently to receive the electrolyte 3, electrodes 4 and 5, component 6 to be stripped, and associated electrical connections 12–14, as described hereinafter. The material of the receptacle 2 may also vary as long as it is non-reactive and does not interfere with the electrochemical stripping process.

The electrochemical stripping system 1 comprises at least one electrode. The description will refer to two electrodes, and the figures illustrate two electrodes, 4 and 5, however these are merely exemplary and not intended to limit the invention in any manner. Each electrode, 4 and 5, is formed with an appropriate geometry that is configured to direct electrical fields to the surfaces of the coated article 6. Appropriate geometric configurations for the electrodes 4 and 5 within the scope of the invention include, but are not limited to, planar geometries, cylindrical geometries, and combinations thereof (see FIG. 3). Alternatively, each electrode 4 and 5 can comprise a complex geometrical configuration, such as a geometrical configuration that is approximately complementary to the geometry of the article 6 that is to be stripped (see FIG. 2). The electrodes 4 and 5 are generally non-consumable and remain intact throughout the electrochemical stripping process.

The article 6, which is to be stripped by the electrochemical stripping system 1, is disposed in the receptacle 2. As discussed above, the article to be stripped comprises a coated article 6, for example, but not limited to, a turbine component. However, this description is merely exemplary and is not intended to limit the invention in any manner. The turbine component 6 is disposed between the electrodes 4 and 5, and positioned so that an electric field can be established between the electrodes 4 and 5 and the selected coated surfaces of the turbine component 6. The electrolyte 3 is delivered to the receptacle 2 in amounts sufficient to submerge parts of the turbine component 6 and electrodes 4 and 5. If a portion 7 of the turbine component 6, for example a dovetail section, does not require stripping, this portion may be kept above the electrolyte 2. Alternatively, this portion 7 of the turbine component 6 can be physically masked so as to shield the electric field. A further alternative is to minimize the electric field over this portion of the component surface, for example by modifying the electrode location. The portions of the turbine component 6 that are to be electrochemically stripped should be submerged in the electrolyte 3.

Figure 4:
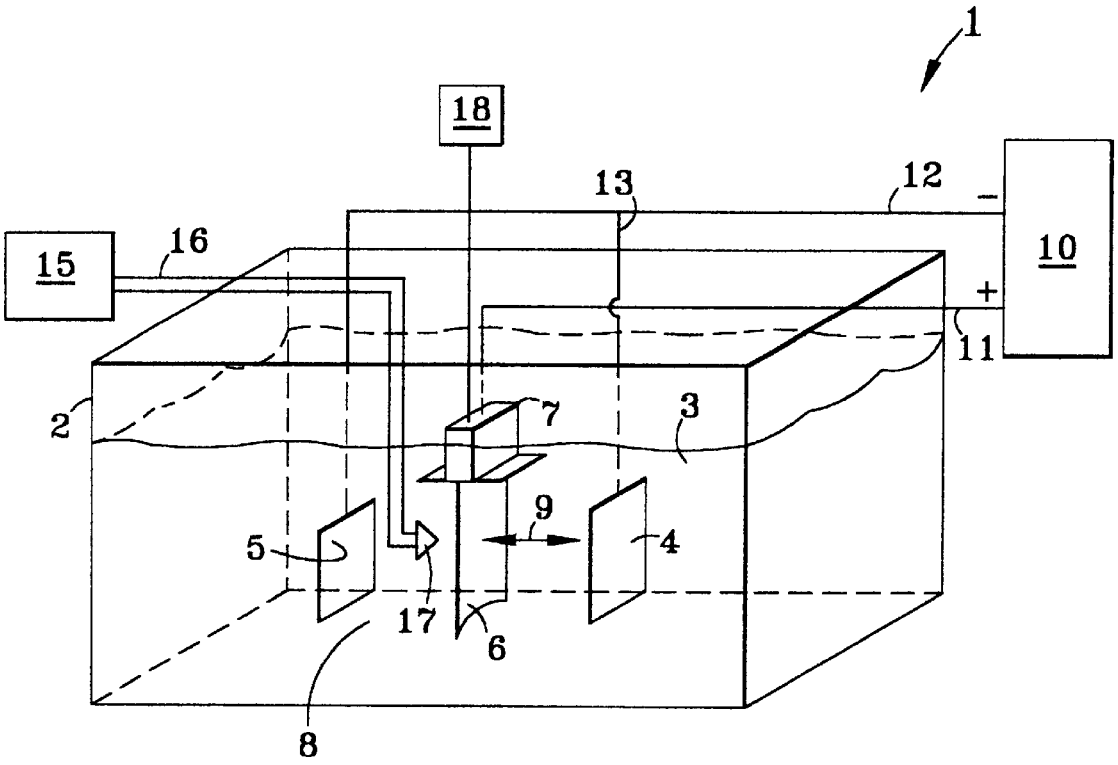
FIG. 4 is a schematic illustration of another electrochemical stripping system.

The electrolyte 3 can be delivered into the receptacle 2 by any appropriate means. For example, and in no way limiting of the invention, the electrolyte 3 may be poured into the receptacle 2. Alternatively, the electrolyte 2 can be delivered into the receptacle 2 by a pumping device 15 (FIG. 4). The pumping device 15 is connected to the receptacle 2 via a conduit 16. The conduit 16 extends to a gap 8 that is disposed between the turbine component 6 and one of the electrodes 4 and 5. The pumping device 15 can comprise a low-pressure pump, which agitates and stirs electrolyte 3 in the receptacle 2. For example, ejection of the electrolyte 3 from a nozzle 17 of the pumping device 15 can cause agitation and stirring of the electrolyte 3 in the receptacle 2.

Alternatively, the turbine component 6 can be moved, reciprocally or rotated about its own or a displaced axis by an appropriate support 11, as illustrated by arrow 9 (FIG. 4). The turbine component 6 can be moved by an appropriate motive device 18 in the electrolyte 3, such as but not limited to, at least one of mechanical and magnetic devices. The movement of the electrolyte 3 accelerates Joule heat dissipation and helps maintain the electrolyte composition homogeneous during the electrochemical stripping process. Excessive heat or local changes in electrolyte chemistry may alter the stripping reaction, for example, but not limited to, hindering and slowing reaction times, increasing reaction rates, or increasing parent alloy attack.

A direct current (DC) power supply 10 establishes an electric field in the electrochemical stripping system 1. The DC power supply 10 carries current over connections 12, 13, and 14, to the electrodes 4 and 5. The electrodes, 4 and 5, are connected to the negative terminals of the DC power supply 10. The stripping of the coating from the turbine component 6 comprises the electrolyte reacting with the coating. The electrolyte carries charge to the turbine component 6 and under the action of the DC current, the coating is stripped from the turbine component 6. Removal of the DC current halts the electrochemical stripping process.

In the electrochemical stripping process, as embodied by the invention, electrochemical stripping process parameters (hereinafter "stripping parameters") define the stripping characteristics. These stripping parameters influence the rate of material removal and thus the efficiency of the stripping process. The stripping parameters include, but are not limited to, electrode geometry, DC power supply voltage or current (dependent on parameters being controlled), electrolyte concentrations, solvent composition, distance between the article and electrodes, and electrolyte temperature. The stripping parameters may vary over operational ranges. For example, the DC power supply voltage may vary from a trace voltage (the term "trace" means a small but measurable value) to at least about 30V. The distance between the turbine component 6 and an electrode may vary in a range from about 0.1 inches to about 10 inches. The temperature of the electrolyte may vary up to about 150° C. The stripping time depends on a coating's composition, microstructure, density, and thickness. The electrochemical stripping time may increase with higher density and thicker coatings. Therefore, the stripping time of an electrochemical stripping process, as embodied by the invention, may vary in a range from about 0.1 minutes to about 4 hours.

Table I sets forth charge-carrying components of electrolytes, as embodied by the invention, with ranges of effective concentrations for the process, as embodied by the invention. Table I also provides a concentration that has been found to be effective for stripping, as embodied by the invention. Table II provides solvents, as embodied by the invention, in which the charge-carrying components set forth in Table I are disposed to form the electrolytes.

TABLE I

CHARGE-CARRYING COMPONENTS OF ELECTROLYTES

| Name | Formula | Concentration Range (wt %) | Exemplary Conc (wt %) |
|---|---|---|---|
| Nitric Acid | $HNO_3$ | 3–13 | 8 |
| Phosphoric Acid | $H_3PO_4$ | 3–13 | 8 |
| Hydrochloric Acid | HCl | <10 | 5 |
| Methanesulfonic Acid | $CH_3SO_3H$ | 5–15 | 10 |
| Phosphoric Acid + Sulfuric Acid (~50/50 mixture) | $H_3PO_4$+ $HSO_4$ | 5–15 | 10 |
| Sodium Hydroxide | NaOH | 5–15 | 10 |
| Ammonium Hydroxide | $NH_4OH$ | 5–15 | 10 |
| Sodium Chloride | NaCl | 5–20 | 10 |
| Magnesium Sulfate | $MgSO_4$ | 5–15 | 10 |
| Methane Sulfonic Acid Sodium Salt | $CH_3SO_3H$—Na | <10 | 5 |
| Sodium Carbonate + | $NaHCO_3$ + | <10 | 5 |
| Sodium Bicarbonate | $Na_2CO_3$ | <10 | 5 |
| (~50/50 mixture) | | | |
| Oxalic Acid Disodium Salt | $Na_2C_2O_4$ | <7 | 1.5 |
| Acetic Acid Sodium Salt | $NaC_2H_3O_2$ | 10–20 | 15 |
| Oxamate | $HO_2CCONH_2$ | <7 | 1.5 |
| Citric Acid Trisodium Salt | $HOC(CH_2CO_2Na)_2CO_2Na$ | 10–20 | 15 |
| Lactic Acid | $CH_3CH(OH)CO_2H$ | 10–20 | 15 |
| Malonic Acid Disodium Salt | $CH_2(CO_2Na)_2$ | 10–20 | 15 |
| Ammonium Nitrate | $NH_4NO_3$ | <10 | 5 |
| Sodium Bromide | NaBr | 5–15 | 10 |
| Sodium Fluoride | NaF | 10–20 | 15 |
| Sodium Nitrate | $NaNO_3$ | 5–15 | 10 |
| Potassium Chloride | KCl | 5–15 | 10 |
| Ammonium Bifluoride | $NH_4HF_2$ | 15–25 | 20 |
| Ammonium Chloride | $NH_4Cl$ | 3–20 | 15 |

TABLE II

ELECTROLYTE SOLVENTS

| Solvent name | Formula | Volume Percent (v/o Range) | Exemplory Volume Percent (v/o) |
|---|---|---|---|
| Water | $H_2O$ | | |
| Diethylene Glycol | $CH_2OHCH_2OCH_2CH_2OH$ | 25/75 to 75/25 | 50/50 |
| + | + | | |
| Water | $H_2O$ | | |
| Glycerol | $CH_2OHCHOHCH_2OH$ | 25/75 to 75/25 | 50/50 |
| + | + | | |
| Water | $H_2O$ | | |
| Ethylene Carbonate | (—$CH_2O$)CO | 25/75 to 75/25 | 50/50 |
| + | + | | |
| Water | $H_2O$ | | |
| Propylene Glycol | $CH_3CHOHCH_2OH$ | 25/75 to 75/25 | 50/50 |
| + | + | | |
| Water | $H_2O$ | | |
| Ethylene Glycol | $C_2O_2H_6$ | | |

Figure 2:
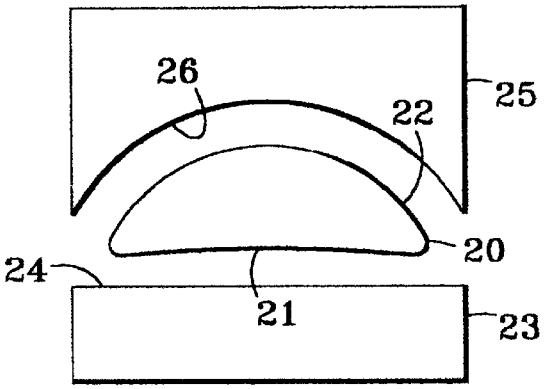
FIG. 2 is a schematic illustration of an exemplary geometrical configuration for a cathode and anode arrangement in an electrochemical stripping system.
Figure 3:
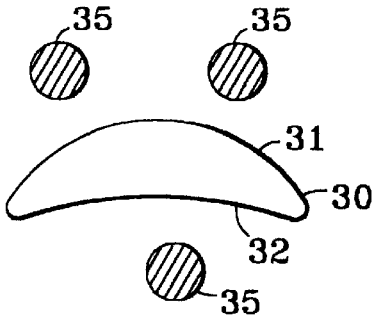
FIG. 3 is a schematic illustration of another exemplary geometrical configuration for a cathode and anode arrangement in an electrochemical stripping system.

FIGS. 2 and 3 illustrate two exemplary geometries for the electrodes, as embodied by the invention, and are applicable to stripping a metallic coating from a turbine component. The geometries of FIGS. 2 and 3 are merely exemplary of the geometries within the scope of the invention and are not meant to limit the invention in any manner. The electrode configurations of FIGS. 2 and 3 are suitable for use with electrolytes that exhibit chemically non-selective characteristics and highly selective characteristics, respectively.

With the electrode geometry of FIG. 2, a turbine component 20 comprises a configuration with a generally straight side 21 and a convex side 22. An electrode 23 comprises a side 24, which has a configuration that is generally complementary to the side 21. Similarly, an electrode 25 has a side 26 that is generally complementary to the turbine component side 22. Thus, the electrodes 23 and 25 at least partially surround the turbine component 20. Each electrode 23 and 25 is connected to one terminal of the DC power supply, while the turbine component 20 is connected to the other terminal. When current is passed between the electrodes 23 and the turbine component 20, the surfaces of the turbine component 20 will be electrochemically stripped, as embodied by the invention. The electrode configuration of FIG. 2 is suitable for use with electrolytes that are not highly selective, where a higher degree of control over the electrical field is needed.

The electrode configuration of FIG. 3 comprises a turbine component 30 and a plurality of electrodes 35. Alternatively, multiple components to be striped can be presented in the stripping system, as embodied by the invention. The turbine component 30 of FIG. 3 comprises a concave surface 31 and a convex surface 32. The electrodes 35 are disposed around the turbine component 30 to provide an approximately uniform electrical field at the turbine component 30. Each electrode 35 is connected to one terminal of the DC power supply, while the turbine component 30 is connected to the other terminal. When current is passed between the electrodes 35 and the turbine component 30, the surfaces of the turbine component 30 will be electrochemically stripped, as embodied by the invention.

The electrochemical stripping process, as embodied by the invention, effectively removes metallic coatings from a turbine component. The electrochemical stripping process can remove metallic coatings from a turbine component with minimal degradation of other article features, including but not limited to, the parent alloy, coated internal cooling structures, coated cooling holes and other "non-line-of-sight" turbine component surfaces. The electrochemical stripping process uses non-toxic electrolytes, and thus provides an environmentally desirable process. Further, by appropriately adjusting the process parameters, it is possible to control stripping rates while maximizing the electrochemical selectivity of the process.

While various embodiments are described herein, it will be appreciated from the specification that various combinations of elements, variations or improvements therein may be made by those skilled in the art, and are within the scope of the invention.

We claim:

1. An electrochemical stripping process for stripping at least one coating from a coated article that comprises a parent alloy, where the parent alloy remains essentially unmodified after the electrochemical stripping process, said process comprising:

providing an electrolytic comprising a charge-carrying component in a solvent, wherein said charge-carrying component is selected from at least one of a halide salt, methanesulfonic acid, ammonium hydroxide, sodium chloride, magnesium sulfate, methane sulfonic acid sodium salt, a mixture of sodium carbonate and sodium bicarbonate, oxalic acid disodium salt, acetic acid sodium salt, oxamate, citric acid trisodium salt, lactic acid, malonic acid disodium salt, a mixture of ethylene glycol and ammonium citrate, sodium nitrate and ammonium bifluoride; and said solvent is selected from at least one of diathylene glycol and water, glycerol and water, ethylene carbonate and water, or propylene glycol and water;

disposing a coated article and at least one electrode in the electrolyte, the coated article comprising a parent alloy and at least one coating disposed on the parent alloy;

applying a current from a power source between the at least one electrode and the coated article; and removing the at least one coating from the coated article without modifying the parent alloy.

2. A process according to claim 1, wherein the coated article comprises a turbine component.

3. A process according to claim 1, wherein said charge carrying-component comprises a halide salt.

4. A process according to claim 3, wherein said halide salt comprises sodium chloride.

5. A process according to claim 4, wherein the step of providing the sodium chloride in water comprises providing sodium chloride in a range from about 5 w/o to about 15 w/o of the water.

6. A process according to claim 1, wherein the halide salt is selected from sodium chloride, ammonium chloride, or potassium chloride.

7. A process according to claim 1, wherein charge-carrying component is selected from: methanesulfonic acid in range from about 5 w/o to about 15 w/o of the solvent; ammonium hydroxide in range from about 5 w/o to about 15 w/o of the solvent; sodium chloride in range from about 5 w/o to about 20 w/o; magnesium sulfate in range from about 5 w/o to about 15 w/o of the solvent; methane sulfonic acid sodium salt less than about 10 w/o of the solvent; a mixture of sodium carbonate and sodium bicarbonate, each less than about 10 w/o of the solvent; oxalic acid disodium salt, less than about 7 w/o of the solvent; acetic acid sodium salt in range from about 10 w/o to about 20 w/o of the solvent; oxamate, less than about 7 w/o; citric acid trisodium salt in range from about 10 w/o to about 20 w/o of the solvent; lactic acid in range from about 10 w/o to about 20 w/o of the solvent; malonic acid disodium salt in range from about 10 w/o to about 20 w/o of the solvent; a mixture of ethylene glycol and ammonium nitrate less than about 10 w/o of the solvent; sodium bromide in range from about 5 w/o to about 15 w/o of the solvent; sodium fluoride in range from about 10 w/o to about 20 w/o of the solvent; sodium nitrate in range from about 5 w/o to about 15 w/o of the solvent; ammonium bifluoride in range from about 15 w/o to about 25 w/o of the solvent; potassium chloride in range from about 5 w/o to about 15 w/o of the solvent, or ammonium chloride in range from about 3 w/o to about 20 w/o of the solvent.

8. A process according to claim 1, wherein the step of providing an electrolyte comprises providing a mixture of sodium carbonate and sodium bicarbonate in water.

9. A process according to claim 8, wherein the step of providing sodium carbonate/sodium bicarbonate in water comprises providing about 5 w/o of each providing sodium carbonate and sodium bicarbonate in water.

10. A process according to claim 1, wherein the step of providing an electrolyte comprises providing sodium chloride in propylene glycol.

11. A process according to claim 1, wherein the step of disposing the coated article in the electrolyte comprises submerging the coated article in the electrolyte.

12. A process according to claim 1, wherein the step of removing the at least one coating from the coated article comprises reacting the at least one coating with the electrolyte.

13. A process according to claim 12, wherein the step of reacting the coating with the electrolyte produces heat, the process further comprising the step of dissipating heat.

14. A process according to claim 13, wherein the step of dissipating heat comprises at least one of stirring and agitating the electrolyte.

15. A process according to claim 14, wherein the step of at least one of stirring and agitating comprises the step of providing the electrolyte thus causing the step of at least one of stirring and agitating.

16. A process according to claim 13, wherein the step of at least one of stirring and agitating comprises providing a device for at least one of stirring and agitating the electrolyte.

17. A process according to claim 1, wherein the step of disposing at least one electrode comprises:

disposing a plurality of electrodes in the electrolyte, wherein the step of disposing the coated article comprises disposing the coated article between the plurality of electrodes.

18. A process according to claim 17, wherein the step of disposing the plurality of electrodes comprises configuring the plurality of electrodes into a configuration that at least partially surround the coated article, and the step of disposing the coated article between the plurality of electrodes comprises disposing the coated article in between the plurality of electrodes so the plurality of electrodes at least partially surround the coated article.

19. A process according to claim 18, the process further comprises applying a current between the plurality of electrodes and the coated article, the current causing a reaction of the at least one coating and the electrolyte that results in the removing of the at least one coating from the coated article.

20. A process according to claim 19, wherein the step of applying the current between the plurality of electrodes and the coated article comprises passing a constant current between the plurality of electrodes and the coated article.

21. A system for electrochemical stripping of at least one coating from an article that comprises a parent alloy where the parent alloy remains essentially unmodified after the electrochemical stripping, the system comprising:

an electrolyte, said electrolyte comprising a charge-carrying component in a solvent, wherein said charge-carrying component is selected from at least one of a halide salt, methanesulfonic acid, ammonium hydroxide, sodium chloride, magnesium sulfate, methane sulfonic acid sodium salt, a mixture of sodium carbonate and sodium bicarbonate, oxalic acid disodium salt, acetic acid sodium salt, oxamate, citric acid trisodium salt, lactic acid, matonic acid disodium salt, a mixture of ethylene glycol and ammonium citrate, sodium nitrate and ammonium bifluoride; and said solvent is selected from at least one of diethylene glycol and water, glycerol and water, ethylene carbonate and water, or propylene glycol and water;

an electrolyte bath receptacle containing said electrolyte;

at least one electrode, said at least one electrode at least partially submerged in said electrolyte; and a direct current source electrically connected to said at least one electrode;

wherein the direct current source is capable of being electrically connected to the coated article and the at least one electrode to allow direct current to flow through said electrolyte between said at least one electrode and said coated article, and wherein the system permits removal of the at least one coating from the coated article without modifying the parent alloy.

22. A system according to claim 21, wherein the coated article comprises a turbine component.

23. A system according to claim 21, wherein the at least one electrode comprises a plurality of electrodes, and the coated article is disposed between the plurality of electrodes.

24. A system according to claim 21, wherein the plurality of electrodes comprise a configuration that surrounds the coated article, the coated article is disposed between the plurality of electrodes.

25. A system according to claim 21, wherein the direct current source applies a direct current to the article, the direct current causing a reaction of the at least one coating and the at least one electrode that results in the stripping of the at least one coating from the article.

26. A system according to claim 21, wherein the direct current comprises a constant direct current.

27. A system according to claim 21, wherein the system further comprises a heat dissipation device that dissipates heat caused by the removal of the at least one coating.

28. A system according to claim 27, wherein the heat dissipation device comprises a device that is capable of at least one of stirring and agitating the electrolyte.

29. A system according to claim 21, wherein the electrolyte comprises a halide salt.

30. An electrochemical stripping process for stripping at least one coating from a coated article that comprises a parent alloy, in which the at least one coating is stripped from the parent alloy by the electrochemical stripping process and the parent alloy remains essentially unmodified after the electrochemical stripping process, the electrochemical stripping process comprising:

providing an electrolyte that comprises a charge-carrying component and a solvent, wherein the charge-carrying component comprises sodium chloride and the solvent comprises a solvent selected from at least one of diethylene glycol and water, glycerol and water, ethylene carbonate and water, or propylene glycol and water;

disposing a coated article and at least one electrode in the electrolyte, the coated article comprising a parent alloy and at least one coating disposed on the parent alloy;

applying a current from a power source between the at least one electrode and the coated article; and removing the at least one coating from the coated article without modifying the parent alloy.

31. An electrochemical stripping process for stripping at least one coating from a coated article that comprises a parent alloy, in which the at least one coating is stripped from the parent alloy by the electrochemical stripping process and the parent alloy remains essentially un-modified after the electrochemical stripping process, the electrochemical stripping process comprising:

providing an electrolyte that comprises a charge-carrying component and a solvent, the charge-carrying component comprises a mixture of sodium carbonate and sodium bicarbonate and the solvent comprises water;

disposing a coated article and at least one electrode in the electrolyte, the coated article comprising a parent alloy and at least one coating disposed on the parent alloy;

applying a current form a power source between the at least one electrode and the coated article; and removing the at least one coating from the coated article without modifying the parent alloy.

32. An electrochemical stripping process for stripping at least one coating from a coated article that comprises a parent alloy, in which the at least one coating is stripped from the parent alloy by the electrochemical stripping process and the parent alloy remains essentially un-modified after the electrochemical stripping process, the electrochemical stripping process comprising:

providing an electrolyte that comprises a charge-carrying component and a solvent, the charge-carrying component comprises sodium chloride and the solvent comprises propylene glycol;

disposing a coated article and at least one electrode in the electrolyte, the coated article comprising a parent alloy and at least one coating disposed on the parent alloy;

applying a current from a power source between the at least one electrode and the coated article; and removing the at least one coating from the coated article without modifying the parent alloy.

33. An electrochemical stripping process for stripping at least one coating from a coated article that comprises a parent alloy, in which the at least one coating is stripped from the parent alloy by the electrochemical stripping process and the parent alloy remains essentially unmodified after the electrochemical stripping process, the electrochemical stripping process comprising:

providing an electrolyte that comprises a charge-carrying component and a solvent, wherein the charge-carrying component comprises at least one of ammonium hydroxide, magnesium sulfate, oxamate, sodium nitrate, and a mixture of sodium carbonate and sodium bicarbonate; and the solvent comprises water;

disposing a coated article and at least one electrode in the electrolyte, the coated article comprising a parent alloy and at least one coating disposed on the parent alloy;

applying a current from a power source between the at least one electrode and the coated article; and removing the at least one coating from the coated article without modifying the parent alloy.

* * * * *